United States Patent [19]

Salandre

[11] Patent Number: 4,835,863

[45] Date of Patent: Jun. 6, 1989

[54] SINGLE CATCH KNIFE SHEATH CONSTRUCTION

[76] Inventor: Stephen M. Salandre, 10413 Baldwin NE., Albuquerque, N. Mex. 87112

[21] Appl. No.: 189,866

[22] Filed: May 3, 1988

[51] Int. Cl.[4] ..... B26B 29/02

[52] U.S. Cl. ..... 30/143; 30/151; 224/232

[58] Field of Search ..... 30/143, 151, 162, 296; 224/232, 233, 242

[56] References Cited

U.S. PATENT DOCUMENTS

| | | | |
|---|---|---|---|
| 2,527,710 | 10/1950 | Davidson, Jr. . | |
| 2,527,711 | 10/1950 | Davidson | 30/151 |
| 2,528,059 | 10/1950 | Kendrick . | |
| 2,793,434 | 5/1957 | Wigington | 30/151 |
| 2,859,516 | 11/1958 | McQueary | 30/151 |
| 2,901,823 | 9/1959 | Widen | 30/151 |
| 3,246,813 | 4/1966 | Miller | 30/162 X |
| 3,524,570 | 8/1970 | Seguine | 30/151 |
| 4,414,744 | 11/1983 | Collins | 30/151 |

*Primary Examiner*—Frank T. Yost
*Assistant Examiner*—Michael D. Folkerts
*Attorney, Agent, or Firm*—Henderson & Sturm

[57] ABSTRACT

A single catch knife sheath construction (10) comprising a sheath unit (11) having an intermediate sheath layer (23) which defines both the contour and dimensions of the sheath opening (26) so as to accept a knife (100) in either a right handed or left handed disposition; and, a retention unit (12) operatively associated with the sheath unit (11), and including a spring loaded retention member (35) having a catch element (38) that is adapted to engage one side of the top of the hand guard (102) of a knife (100).

8 Claims, 1 Drawing Sheet

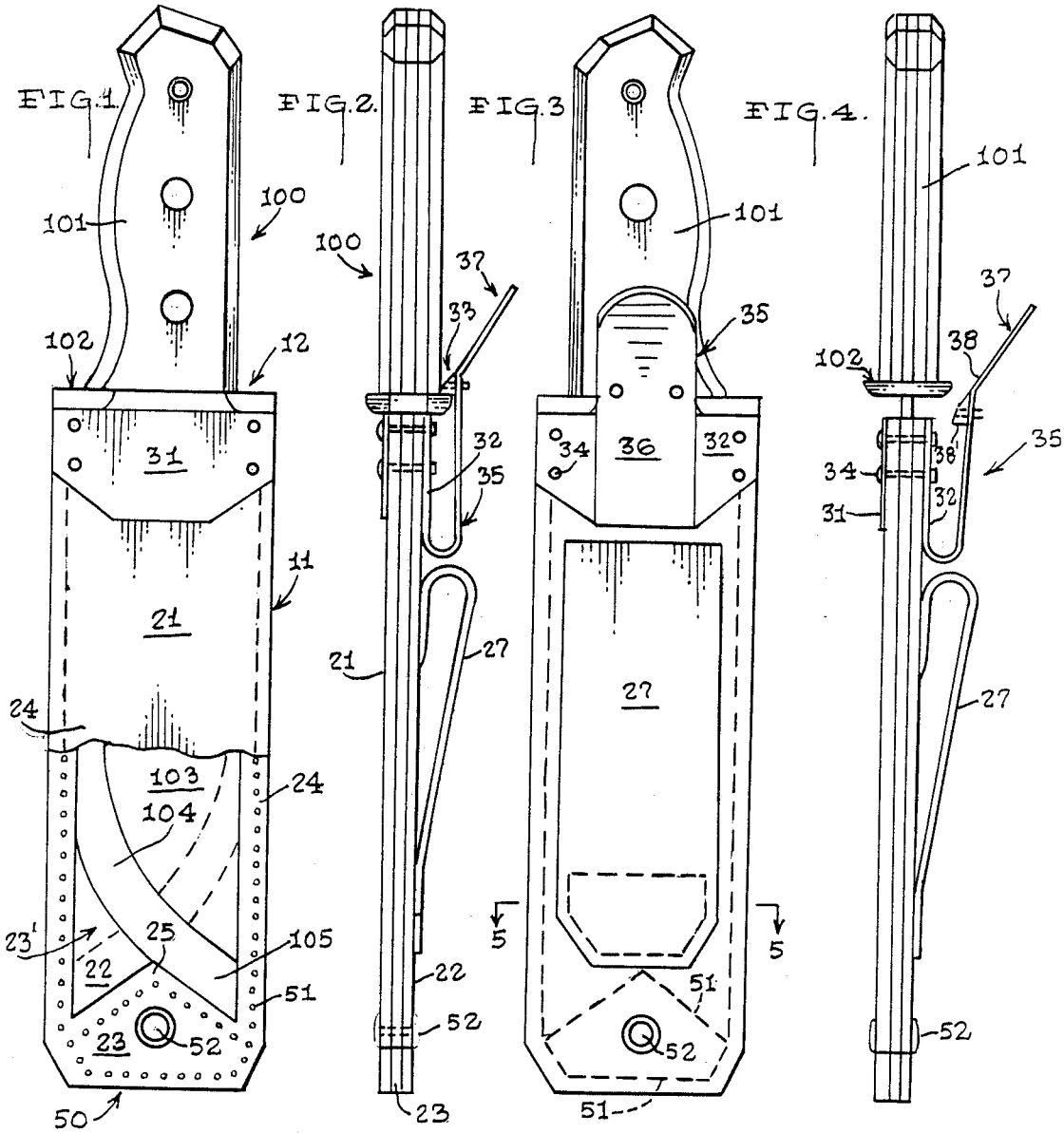
FIG. 1.
FIG. 2.
FIG. 3
FIG. 4.
100
101
102
12
31
11
21
24
103
104
105
23'
25
22
51
23
52
50
37
33
32
35
27
34
36
5
38
38'
38"
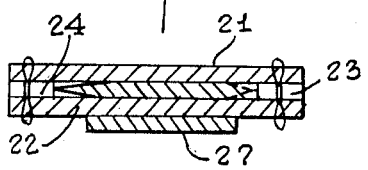
FIG. 5.
24
21
23
22
27
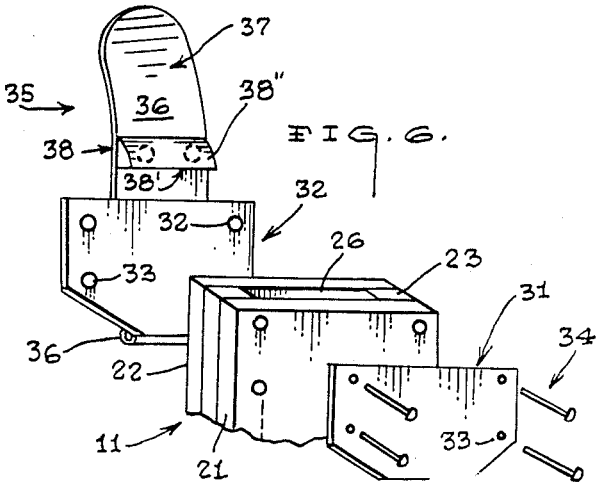
FIG. 6.
37
35
36
38"
38
38'
32
26
23
33
31
34
36
22
11
21

SINGLE CATCH KNIFE SHEATH CONSTRUCTION

TECHNICAL FIELD

The present invention relates generally to knife retention apparatus and more specifically to a retention apparatus that is incorporated into the construction of an improved knife sheath.

BACKGROUND OF THE INVENTION

The present invention was the subject matter of D.D.P. Registration No. 170497 that was submitted to the U.S. Patent and Trademark Office on May 21, 1987.

As can be seen by reference to the following U.S. Pat. Nos.: 4,414,744; 2,527,710; 2,793,434; and 2,528,059 the prior art is replete with myriad and diverse constructions used to retain a knife in a belt sheath. Obviously by virtue of the fact that so many different patented constructions have been developed over a period of decades, there has existed a very real and persistent problem associated with the inadvertent disengagement and loss of a knife from a belt sheath.

In addition, while the aforementioned prior art constructions no doubt function in the manner for which they were intended; they apparently also are only merely adequate for that purpose, by virtue of the fact that variations on the same general principal are constantly being developed and granted patent protection.

It is further to be noted that most of the prior art constructions dispose their knife catch retention means on the outboard vertical surface of the knife sheath; wherein, not only is the knife retention means visible to a casual observer who may wish to gain access to the sheathed knife, but the externally exposed disposition of the retention means may also cause the premature disengagement of the knife from the sheath, when the retention means becomes snagged on brush or otherwise engaged by external elements.

Furthermore, in those prior art sheath constructions which are specifically designed for single edged drop point knife blades, the orientation of the knife blade within the sheath is a one way proposition; wherein, the knife blade cannot readily be inserted in opposite directions relative to the sheath interior to provide either a left or right handed orientation of the knife handle.

Obviously in situations wherein the knife possesses a uniform double bladed dagger configuration, the particular orientation of the knife blade and handle will have minimum impact on the ease and facility with which the user will employ the knife. However, when the knife in question is a single edged hunting or utility blade the more readily accessible the knife handle is to the users grasp, the more use and enjoyment that will be derived by the knife owner.

Furthermore, in conventional leather sheath constructions wherein the sheath comprises only two opposed layers of material held together by stitching or other means, the repeated insertion of the sharp knife blade into the seam between the opposed sheath layers will ultimately result in the rupturing of the seam binding means, which will render the sheath inoperative.

BRIEF SUMMARY OF THE INVENTION

Briefly stated, the knife sheath construction that forms the basis of the present invention comprises in general: a sheath unit and a retention unit that is operatively associated with the sheath unit for captively engaging the hand guard or quillon of a knife handle to prevent the disengagement of the knife blade relative to the sheath unit.

The sheath unit comprises a multi-layer sheath member having an outer sheath layer; an inner sheath layer; and at least one contoured intermediate sheath layer wherein the intermediate sheath layer defines the dimensions of the sheath opening. In addition, the bottom of the intermediate sheath layer is adapted to snugly receive and support the point of the knife blade in either a right handed or left handed mode of insertion; wherein, the intermediate sheath layer will prevent the knife blade from coming into contact with the bound seams of the sheath unit.

The retention unit is operatively associated with the upper portion of the sheath unit, and comprises face plate member and a back plate member that are disposed on opposite sides of the sheath unit and rigidly secured to one another. In addition, the back plate member is provided with a spring loaded capture element that is adapted to releasably engage the quillon of a knife handle.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is a front plan view of the single catch knife sheath construction;

FIG. 2 is a side plan view of the sheath construction with the knife in the engaged mode;

FIG. 3 is a rear plan view of the sheath construction;

FIG. 4 is a side plan view f the sheath construction with the knife in the disengaged mode;

FIG. 5 is a cross-sectional view taken thru line 5—5 of FIG. 3; and, FIG. 6 is an exploded perspective view of the retention unit.

BEST MODE FOR CARRYING OUT THE INVENTION

As can be seen by reference to the drawings and in particular to FIG. 1, the single catch knife sheath construction that forms the basis of the present invention is designated generally by the reference numeral (10). The knife sheath construction (10) comprises in general: a sheath unit (11) and a retention unit (12). These units will now be described in seriatim fashion.

As shown in FIGS. 1 thru 3, and 5, the sheath unit (11) comprises a sheath member (20) including an outer sheath layer (21), an inner sheath layer (22), and a contoured inner sheath layer (23) which are joined together by securing means (50) such as stitching (51) and/or rivets (52). Both the outer (21) and inner (23) sheath layers comprise generally elongated rectangular generally thick sheets of sheath material (24) such as leather, plastic or the like; wherein, the inner sheath layer is further provided with a belt loop element (27).

In addition, the intermediate sheath layer (23) is fabricated from like sheath material (24) and is further provided with a generally elongated U-shaped configuration; wherein, the base of the generally U-shaped intermediate sheath layer is provided with a generally raised triangular portion (25), whose purpose and function will be described presently.

As can best be appreciated by reference to FIGS. 1, 5 and 6, the intermediate sheath layer (23) defines the width, depth, and configuration of the opening (26) of the sheath unit (11); wherein, the thickness of the intermediate layer material (24) defines the width of the sheath opening (26); and, wherein the open space (23') in the generally U-shaped intermediate sheath layer (23) defines the depth and contour of the sheath opening (26).

As can be seen in FIGS. 1 thru 3, the periphery of the sheath unit (11) is joined by securing means (50) in the form of stitching (51) which joins the opposed edges of the outer (21) inner (22) and intermediate (23) sheath layers together, wherein a strengthening rivet (52) secures the bottom portion of the outer (21) and inner (22) sheath layers to the raised generally triangular portion (25) of the intermediate sheath layer (23), and additional stitching (51') is employed to surround the rivet (52) at the base of the sheath unit (11).

As shown in FIGS. 1 thru 4, the single catch knife sheath construction (10) is intended for use with a knife (100) including a knife handle (101) a quillon or hand guard (102) and a knife blade (103) having a single cutting edge (104) which terminates in a generally curved knife point (105).

Turning now to FIGS. 1 thru 4, and 6, it can be seen that the retention unit (12) comprises a retention member (30) which includes a face plate (31) and backing plate (32). As shown in FIGS. 1 and 3, both the face plate (31) and the backing plate (32) have a generally rectangular configuration and extend across the width and cover the upper portion of inner and outer sheath layers (22, 21).

In addition, both the face plate (31) and the backing plate (32) are provided with a plurality of aligned apertures (33) which are dimensioned to receive a plurality of fastening members (34) such as puned rivet pins, threaded screws, or the like; wherein the fastening members (34) are adapted to be received in suitably dimensioned apertures (35) formed in the inner (22) outer (21) and intermediate (23) sheath layers to rigidly secure the face (31) and backing (32) plates to each other and the sheath unit (11). Furthermore, both the backing (32) and face (31) plates act as stiffening members for the sheath construction (10) to provide reinforcement to the sheath throat opening (26).

As can best be seen by reference to FIGS. 2 thru 4, the backing plate (32) is provided with an integral spring loaded retention member (35) comprising a leaf spring element (36) that initially projects downwardly and outwardly from the lower end of the backing plate (32) and then curves upwardly into a generally parallel relationship relative to the backing plate (32) wherein the free end of the leaf spring element (36) is angled away from the backing plate (32) to form a thumb latch element (37); wherein, the leaf spring element (36) and the thumb latch element (37) have a width that is approximately equal but less than the width of the knife handle (101), whereby the spring loaded retention member (35) will be substantially concealed by the presence of the knife (100).

Turning now to FIGS. 2, 4, and 6, it can be seen that the spring loaded retention member (35) is further provided with a catch element (38) disposed proximate the juncture of the thumb latch element (37) with the remainder of the leaf spring element (36); wherein, the catch element (38) is provided with a horizontally disposed lower catch surface (38') and an outwardly curved transition surface (38''), and wherein the horizontally disposed lower catch surface (38') is disposed and dimensioned to rest upon the top of the knife hand guard or quillon (102) when the knife (100) is operatively engaged in the sheath unit (11).

As can be seen by reference to FIGS. 2 and 4, when the knife (100) is sheathed the lower catch surface (38') of the catch element (38) will rest only upon the top of one side of the knife hand guard (102); wherein, the vertical orientation of the leaf spring element (36) will resist the vertical displacement of the knife (100) relative to the sheath unit (11). When the user wishes to disengage the knife (100) from the sheath unit (11), it is necessary for the user to engage the thumb latch element (37) and exert an outwardly directed force thereon to overcome the force of the leaf spring element (36) to displace the catch element (38) from engagement with the knife quillon (102).

It should also be noted that when the knife (100) is inserted into the sheath unit (11) the transition surface (38'') on the catch element (38) will act as a camming surface to force the leaf spring element (36) outwardly and away from the retention unit (12) until such time as the lower catch surface (38') will snap back into locking engagement with the top of the knife hand guard (102).

Also in the preferred embodiment of the invention depicted in the drawings, the leaf spring element (36) is chosen to produce a minimum horizontal deflection resistance of approximately (5 lbs.) five pounds of force; whereby, a selected minimum amount of outwardly directed force will have to be exerted against the thumb latch element (37) to effect the disengagement of the catch element (38) from the knife (100) to prevent removal of the knife (100) from the sheath construction (10) by children or other individuals.

Furthermore, the leaf spring element (36) is chosen to have a minimum vertical retention strength; wherein the amount of downwardly directed force required to disengage the catch element (38) from the knife hand guard (102) is in the order of 10:1 with respect to the horizontally directed force that will produce the same result.

An example of the 10:1 ratio between the vertical retention strength and the horizontal deflection resistance of the leaf spring element (36) was accomplished by fabricating the leaf spring element from 0.032 inch thick 1095 alloy spring steel. In this example the measured horizontal deflection resistance of the leaf spring element (36) was overcome when an outwardly directed force of approximately (4 lbs. 8 oz.) four pounds eight ounces was exerted against the leaf spring element (36); while the identical leaf spring element resisted a vertically directed force of (50 lbs.) fifty pounds.

Obviously, while the foregoing example produced slightly more than a 10:1 ratio between the vertical retention strength and the horizontal deflection resistance of the leaf spring (36) it is intended that this invention will encompass leaf springs having at a minimum an 8:1 ratio between the vertical retention strength and the horizontal deflection resistance as set forth above.

In conclusion, it should also be noted that the catch element (38) is intended to be fabricated from material that is softer than the material from which the hand guard (102) is fabricated, so as to prevent the catch element (38) from scratching the surfaces of the knife hand guard (102).

Having thereby described the subject matter of this invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A sheath construction for knives having knife handle, a hand guard, and a single edged knife blade having a curved point wherein the sheath construction comprises:

a sheath unit comprising a sheath member having an outer sheath layer, an inner sheath layer, and an intermediate sheath layer which are joined together by securing means; wherein, the intermediate sheath layer defines the dimensions of the sheath opening and has an elongated generally U-shaped configuration; and, wherein the base of the generally U-shaped intermediate sheath layer is further provided with a generally triangular raised central portion; whereby, the curved point of the knife lade will rest on the said raised central portion of the of the intermediate sheath layer when the knife is inserted in either a right handed or a left handed disposition.

2. The sheath construction as in claim 1 further comprising:

a retention unit operatively associated with said sheath unit and the knife hand guard for releasably securing the knife within said sheath unit.

3. The sheath construction as in claim 2 wherein the retention unit comprises:

a face plate; and, a backing plate operatively associated with the face plate and the upper portion of the sheath unit; wherein the backing plate is further provided with a spring loaded retention member.

4. The sheath construction as in claim 3 wherein the spring loaded retention member comprises:

a leaf spring element that initially projects outwardly from the lower end of the backing plate, and then curves upwardly into a generally parallel relationship with the backing plate.

5. The sheath construction as in claim 4 wherein the spring loaded retention member further comprises:

a thumb latch element formed on the free end of said leaf spring element.

6. The sheath construction as in claim 5 wherein the spring loaded retention member further comprises:

a catch element operatively associated with the free end of said leaf spring element.

7. The sheath construction as in claim 6 wherein the catch element includes a horizontally disposed lower catch surface that is dimensioned and oriented on the said leaf spring element to engage only the top of one side of the knife hand guard when the knife is sheathed within said sheath unit.

8. The sheath construction as in claim 7 wherein the catch element further includes a curved transition surface that cooperates with the bottom and one side of the knife hand guard to cam the leaf spring retention member away from the backing plate when the knife is inserted into the sheath unit.

* * * * *